US009884465B2

(12) United States Patent
Sip

(10) Patent No.: US 9,884,465 B2
(45) Date of Patent: Feb. 6, 2018

(54) DUNNAGE CONVERSION MACHINE AND METHOD WITH DOWNSTREAM FEED MONITOR

(75) Inventor: Jiri G. Sip, Strongsville, OH (US)

(73) Assignee: RANPAK CORP., Concord Township, OH (US)

( * ) Notice: Subject to any disclaimer, the term of this patent is extended or adjusted under 35 U.S.C. 154(b) by 1063 days.

(21) Appl. No.: 13/979,749

(22) PCT Filed: Jun. 13, 2012

(86) PCT No.: PCT/US2012/042113

§ 371 (c)(1),
(2), (4) Date: Jul. 15, 2013

(87) PCT Pub. No.: WO2012/174027

PCT Pub. Date: Dec. 20, 2012

(65) Prior Publication Data

US 2013/0296154 A1 Nov. 7, 2013

Related U.S. Application Data

(60) Provisional application No. 61/497,721, filed on Jun. 16, 2011.

(51) Int. Cl.
*B31D 5/00* (2017.01)

(52) U.S. Cl.
CPC ..... *B31D 5/0043* (2013.01); *B31D 5/0047* (2013.01); *B31D 2205/0088* (2013.01)

(58) Field of Classification Search
CPC ..... B31D 5/0043; B31D 5/0047; B31D 2205/0088

(Continued)

(56) References Cited

U.S. PATENT DOCUMENTS 3,921,506 A * 11/1975 Hollis ..... B31D 5/0073 493/195
4,026,198 A * 5/1977 Ottaviano ..... B31D 5/0047 493/357

(Continued)

FOREIGN PATENT DOCUMENTS

EP 0 776 760 6/1997
EP 0776760 A1 * 6/1997 ..... B31D 5/0047

(Continued)

OTHER PUBLICATIONS

International Search Report and Written Opinion of International Application PCT/US2012/042113, dated Sep. 21, 2012.

*Primary Examiner* — Hemant M Desai
*Assistant Examiner* — Lucas Palmer
(74) *Attorney, Agent, or Firm* — Renner, Otto, Boisselle & Sklar, LLP.

(57) ABSTRACT

A dunnage conversion machine provides an improved electronic monitoring and control system for detecting and resolving many jamming conditions before they require significant operator intervention. The machine includes a conversion assembly with a feeding device that feeds the sheet stock material through the machine, and a sensing device downstream of the feeding device to monitor movement of the stock material downstream of the feeding device and to output a corresponding signal. A controller controls operation of the feeding device in response to the signal from the sensing device. The controller uses the signal to detect a potential jam condition and controls the feeding device to prevent or minimize the occurrence or severity of the jam condition, thereby minimizing the amount and degree of required operator intervention.

11 Claims, 5 Drawing Sheets

(58) Field of Classification Search
USPC ..... 493/464, 7, 13, 17, 28, 29, 35
See application file for complete search history.

(56) References Cited

U.S. PATENT DOCUMENTS 4,237,776 A * 12/1980 Ottaviano ..... B26D 1/06 493/382
4,429,217 A * 1/1984 Hill ..... B43M 3/045 235/380
4,557,716 A * 12/1985 Ottaviano ..... B31D 5/0047 242/557
4,650,456 A * 3/1987 Armington ..... B31D 5/0047 242/557
4,717,613 A * 1/1988 Ottaviano ..... B31D 5/0047 156/493
4,750,896 A * 6/1988 Komaransky ..... B31D 5/0047 493/357
5,571,067 A * 11/1996 Ratzel ..... B26D 5/00 226/45
5,749,821 A * 5/1998 Simmons ..... B31D 5/0047 198/464.2
5,864,484 A * 1/1999 Harding ..... B31D 5/00 493/464
5,868,657 A * 2/1999 Simmons ..... B31D 5/0047 198/459.7
5,871,429 A * 2/1999 Harding ..... B31D 5/0047 493/25
5,897,478 A * 4/1999 Harding ..... B31D 5/0047 493/22
6,055,795 A * 5/2000 Harding ..... B31D 5/0047 493/22
6,174,273 B1 * 1/2001 Harding ..... B31D 5/0047 493/24
6,179,762 B1 * 1/2001 Harding ..... B31D 5/0047 493/22
6,203,481 B1 * 3/2001 Harding ..... B31D 5/0047 493/10
6,217,501 B1 * 4/2001 Simmons, Jr. ..... B31D 5/0047 493/12
6,524,230 B1 * 2/2003 Harding ..... B31D 5/0047 493/464
6,540,652 B1 * 4/2003 Ratzel ..... B31D 5/0047 493/464
6,626,813 B1 * 9/2003 Ratzel ..... B31D 5/006 493/464
6,676,589 B2 * 1/2004 Kung ..... B31D 5/0047 493/464
6,877,297 B2 * 4/2005 Armington ..... B31D 5/0047 53/168
7,195,585 B2 * 3/2007 Harding ..... B31D 5/0047 493/14
7,722,519 B2 * 5/2010 Timmers ..... B31D 5/0047 493/352
7,866,125 B2 * 1/2011 Simmons, Jr. ..... B31D 5/0047 493/464
8,272,195 B2 * 9/2012 Harding ..... B31D 5/0047 493/29
8,376,114 B2 * 2/2013 Orsini ..... B31D 5/0043 192/127
2001/0014642 A1 * 8/2001 Harding ..... B31D 5/0047 493/354
2001/0017023 A1 * 8/2001 Armington ..... B31D 5/0047 53/472
2001/0019990 A1 * 9/2001 Harding ..... B31D 5/0047 493/22
2002/0037796 A1 * 3/2002 Harding ..... B31D 5/0047 493/350
2005/0150192 A1 * 7/2005 Armington ..... B31D 5/0047 53/472
2005/0178085 A1 * 8/2005 Huis ..... B31D 5/0073 53/403
2005/0255982 A1 * 11/2005 Harding ..... B31D 5/0047 493/464
2007/0283670 A1 * 12/2007 Harding ..... B31D 5/0047 53/474
2009/0082187 A1 * 3/2009 Cheich ..... B31D 5/0047 493/350
2011/0061986 A1 * 3/2011 Orsini ..... B31D 5/0043 192/133
2011/0197550 A1 * 8/2011 Carlson ..... B31D 5/0047 53/472
2011/0295409 A1 * 12/2011 Mierzejewski ..... B31D 5/0047 700/117
2012/0329629 A1 * 12/2012 Wetsch ..... B31D 5/006 493/464

FOREIGN PATENT DOCUMENTS

EP 0776760 B1 * 5/1999 ..... B31D 5/0047
EP 1318076 A2 * 6/2003 ..... B31D 5/0047
EP 1318076 A3 * 10/2003 ..... B31D 5/0047
EP 1658964 A2 * 5/2006 ..... B31D 5/0047
EP 0776760 B2 * 12/2006 ..... B31D 5/0047
EP 1658964 A3 * 2/2008 ..... B31D 5/0047
WO WO 2014186712 A1 * 11/2014 ..... B31D 5/0043

* cited by examiner

DUNNAGE CONVERSION MACHINE AND METHOD WITH DOWNSTREAM FEED MONITOR

FIELD OF THE INVENTION

This invention relates generally to an apparatus and method for converting a stock material into a dunnage product, and more particularly to a dunnage conversion machine and method with means for controlling the speed at which the stock material is fed through the machine.

BACKGROUND

In the process of shipping one or more articles from one location to another, a packer typically places some type of dunnage material in a shipping container, such as a cardboard box, along with the article or articles to be shipped. The dunnage material partially or completely fills the empty space or void volume around the articles in the container. By filling the void volume, the dunnage prevents or minimizes movement of the articles that might lead to damage during the shipment process. Some commonly used dunnage materials are plastic foam peanuts, plastic bubble pack, air bags and converted paper dunnage material.

A supply of dunnage material can be provided to the packer in advance, or the dunnage material can be produced as it is needed. A dunnage conversion machine can be used to convert a supply of stock material, such as a roll or stack of paper, into a lower density dunnage product as it is needed by the packer. For example, U.S. Pat. No. 6,676,589 discloses a dunnage conversion machine that converts a continuous sheet of paper into a crumpled dunnage product.

The mechanism that feeds sheet stock material through a conversion machine can jam, causing the operator to stop the machine, open the machine's housing, physically reach into the machine to clear the stock material from where it is jamming the feed mechanism, close the machine's housing, and then go through a restart sequence before resuming dunnage conversion. Not only is this process time-consuming, but it also may lead to the production of a defective length of dunnage that must be discarded, increasing waste. Jamming is a more common occurrence with lower quality stock material. A jam condition occurs when the feed mechanism is unable to move stock material through the conversion machine, typically because the stock material has caught on something in its path, such as wrapping itself around a portion of the feed mechanism.

SUMMARY OF THE INVENTION

The present invention provides an improved electronic monitoring and control system for detecting and resolving many jamming conditions before they require significant operator intervention. By monitoring movement of the stock material downstream of a feeding device the system can detect a potential jam condition and control the feeding device to prevent or minimize the occurrence or severity of the jam condition, thereby minimizing the amount and degree of required operator intervention. The result is greater run time without required operator intervention and an improved ability to feed lower quality stock material without jamming. The present invention also can improve yield, defined as the length of the stock material compared to the volume of dunnage produced.

More particularly, the present invention provides a machine for converting a sheet stock material into a relatively lower density dunnage product, comprising a conversion assembly for converting a sheet stock material into a relatively lower density dunnage product, the conversion assembly including a feeding device to feed the sheet stock material through the conversion assembly; a sensor downstream of the feeding device to detect movement of the sheet stock material at a point downstream of the feeding device and providing an output corresponding to the movement; and a controller that controls the feeding device based on the output from the sensor.

In an exemplary embodiment, the controller controls the feeding device by slowing the feeding device when the sensor detects a jam condition where the feeding device is energized and no movement is detected by the sensor during a predetermined period.

The present invention also provides a method of controlling a machine that converts a sheet stock material into a relatively lower density dunnage product, comprising the following steps: feeding a sheet stock material through a conversion assembly; sensing movement of the sheet stock material downstream of the conversion assembly; and modulating the feeding step in response to the sensing step. The method may include the step of detecting operation of a feeding device that performs the feeding step, where the modulating step includes reducing the feeding step when the feeding device is operating and no movement is sensed during a predetermined period. If the sensing step includes detecting no movement for a predetermined time, then the modulating step may include stopping the feeding step.

The foregoing and other features of the invention are hereinafter fully described and particularly pointed out in the claims, the following description and annexed drawings setting forth in detail certain illustrative embodiments of the invention, these embodiments being indicative, however, of but a few of the various ways in which the principles of the invention may be employed.

DETAILED DESCRIPTION

Figure 1:
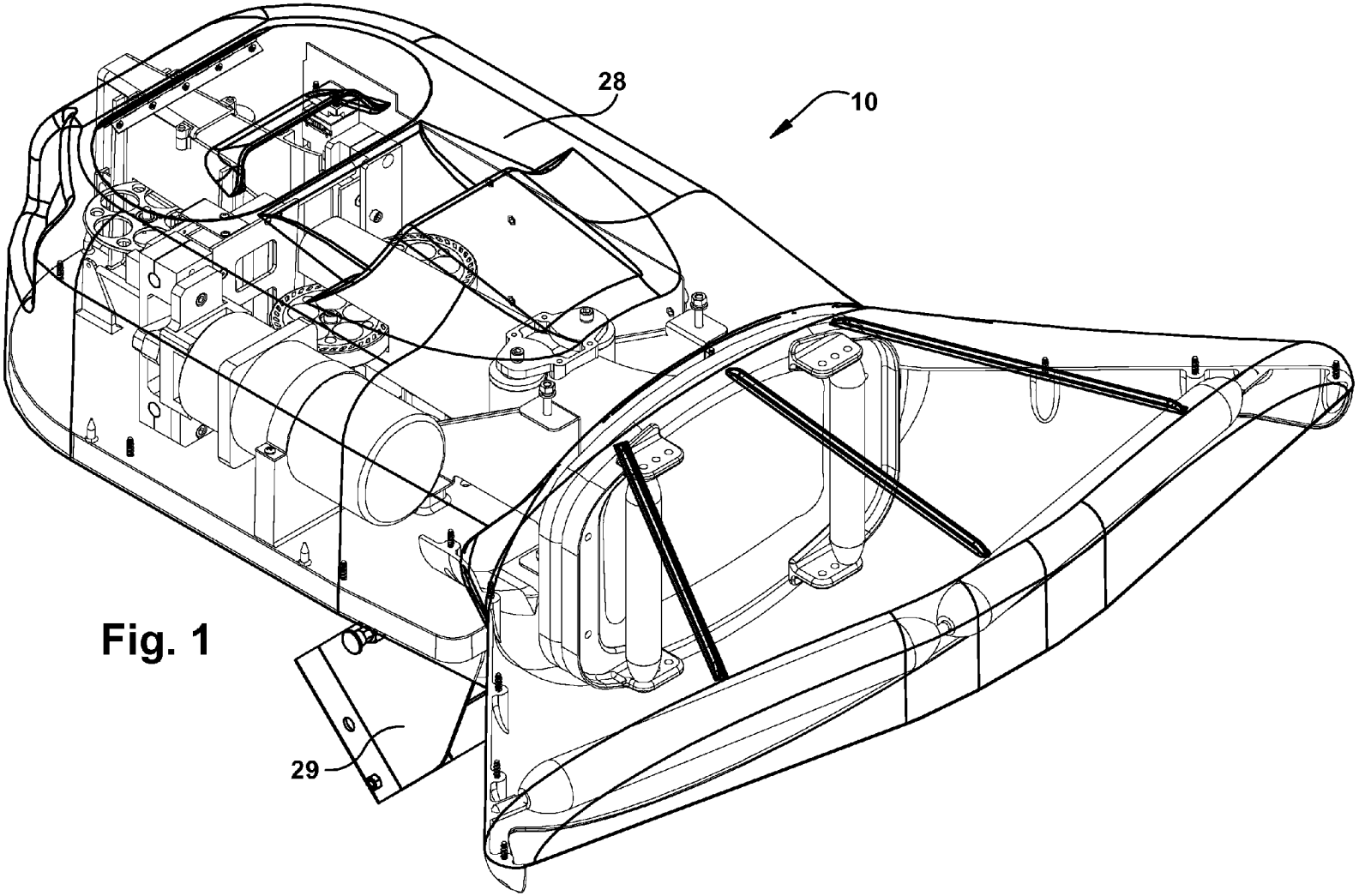
FIG. 1 is a perspective view of an exemplary dunnage conversion machine provided by the present invention with a transparent housing to show internal components of the machine, as seen from above and looking in a downstream direction.
Figure 2:
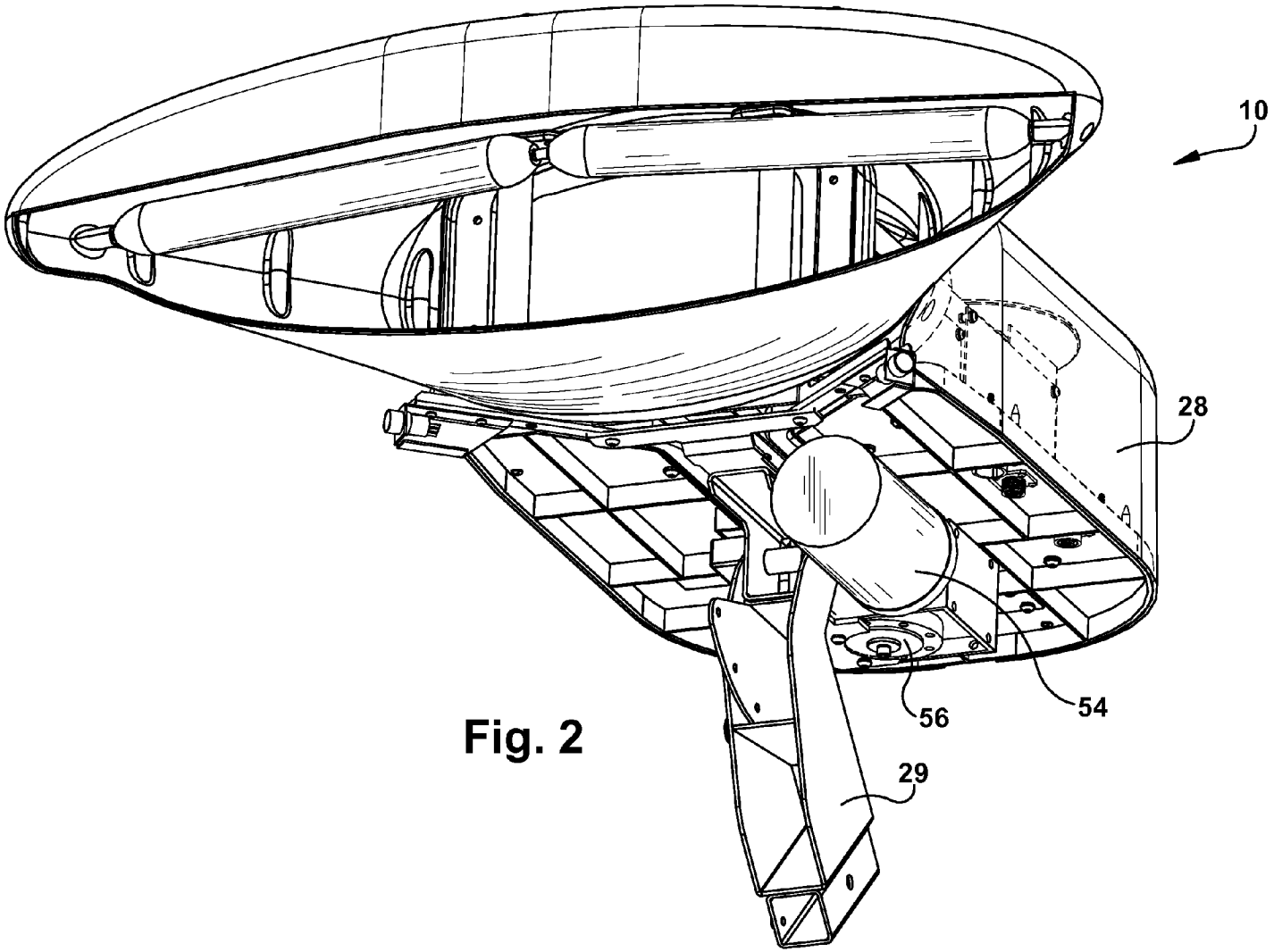
FIG. 2 is a perspective view of the machine of FIG. 1, as seen from below and looking in a downstream direction.
Figure 3:
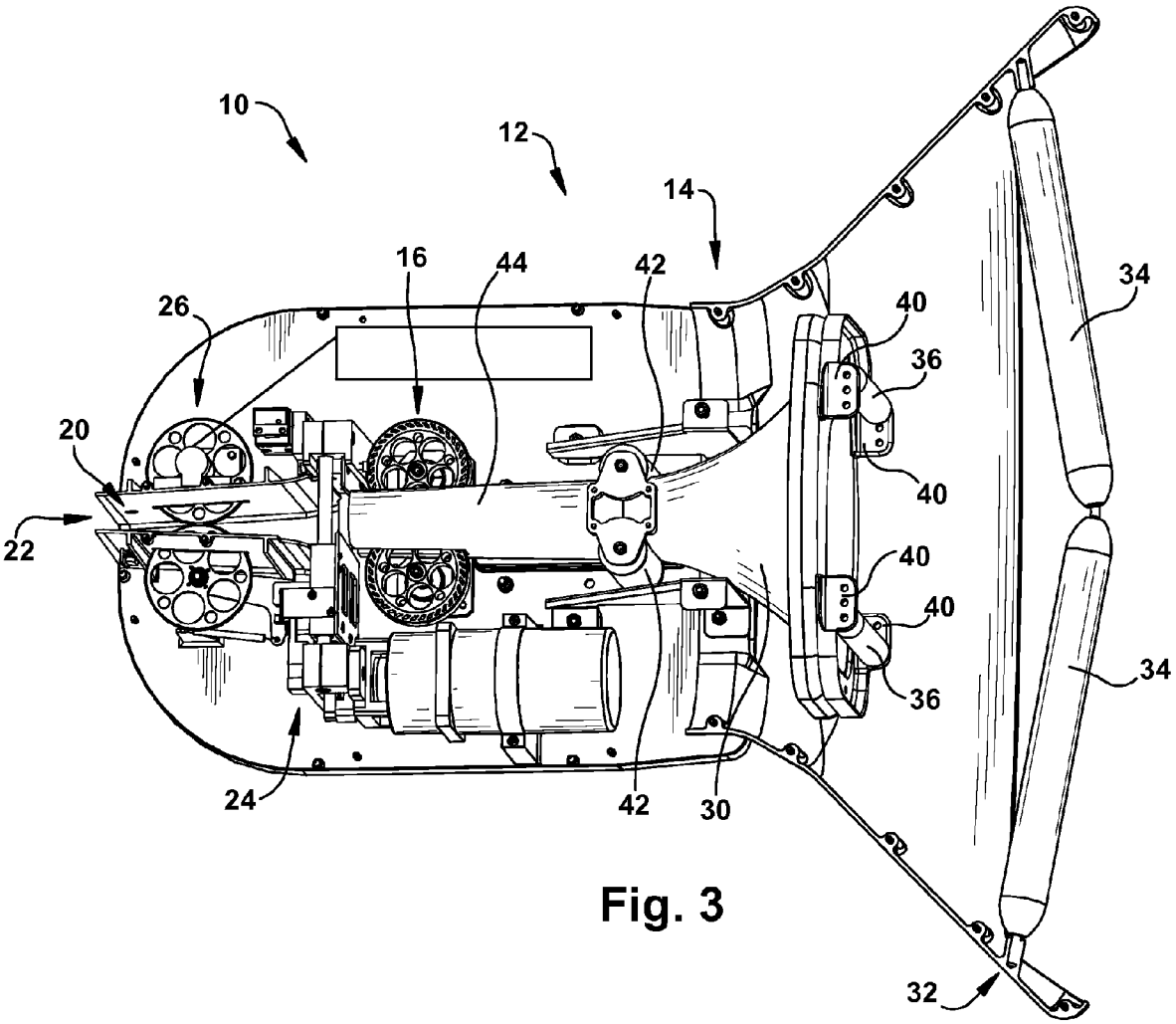
FIG. 3 is a top view, slightly in perspective, of the conversion machine of FIG. 1, with the transparent housing and an internal wall removed to more clearly show the internal components.

Referring now to the drawings in detail, FIGS. 1-3 show an exemplary embodiment of a dunnage conversion machine 10 provided by the present invention that provides an improved electronic monitoring and control system for detecting and resolving many jamming conditions before they require significant operator intervention. By monitoring movement of the stock material downstream of a feeding device the system can detect a potential jam condition and control the feeding device to prevent or minimize the occurrence or severity of the jam condition, thereby minimizing the amount and degree of required operator intervention. The result is greater run time without required operator intervention and an improved ability to feed lower quality stock material without jamming. The present invention also can improve yield, defined as the length of the stock material compared to the volume of dunnage produced.

The conversion machine 10 includes a conversion assembly 12 that has a forming device 14 for guiding and inwardly gathering sheet stock material, a feeding device 16 downstream of the forming device 14 that pulls the sheet stock material from a supply (not shown), through the forming device 14, and through an output chute 20 and out an outlet 22. The conversion assembly 12 also includes a severing device 24 downstream of the feeding device 16 for severing discrete lengths of sheet material, and a sensing device 26 downstream of the feeding device 16 for monitoring movement of the sheet material adjacent the sensing device 26. The sensing device 26 can be upstream or downstream of the severing device 24. The severing 24 device can be omitted, such as where the sheet stock material is already provided in discrete lengths or where discrete lengths are otherwise readily separable, such as by use of a perforated or otherwise weakened stock material that is easily torn. The conversion machine 10 also includes a housing 28 that encloses the conversion assembly 12, and which must be opened or removed to clear a jam and thus resolve a jam condition where the feeding device 16 cannot feed the stock material. The machine 10 also includes a mounting bracket 29 for mounting the machine 10 to a stand or other support.

The forming device 14 includes a converging chute 30 that converges in at least one dimension in a downstream direction. In other words, as the stock material moves through the conversion machine 10 in an upstream-to-downstream direction, a dimension of the converging chute 30 at an upstream end is larger than a corresponding dimension at a downstream end. In particular, a width dimension corresponding to a width dimension of a sheet stock material is reduced to inwardly gather and crumple sheet stock material as it moves through the chute 30. The forming device 14 also includes a constant entry member 32, which in the illustrated embodiment is formed by a pair of rollers 34 aligned end-to-end and positioned at an angle relative to one another. These rollers 34 have rounded ends that allow for some reduction in tension at the edge of the sheet stock material as it is fed into the conversion assembly 12. More particularly, the sheet stock material is fed over the constant entry member 32 and into the converging chute 30. The illustrated chute 30 converges in a both width and height as the stock material moves from an upstream end to a downstream end of the converging chute 30. Regardless of the angle at which the conversion machine 10 is mounted relative to the supply of stock material, the constant entry member 32 guides the stock material into the converging chute 30 along the same path. The constant entry member 32 provides a constant entry plane for the stock material entering the converging chute 30.

The converging chute 30 acts as a funnel and typically is formed as a fixed shape. To provide some adjustability in the amount of inward gathering of the stock material, the illustrated forming device 14 provides a pair of vertical rollers 36 and multi-position mounting tabs 40 at an upstream end the converging chute 30. The mounting tabs 40 provide multiple mounting positions relative to the converging chute 30 for adjusting the effective width of the converging chute 30. At a downstream end of the converging chute 30 the forming device 14 includes another pair of vertical rollers 42 that are closely spaced in fixed positions to further guide the stock material from the converging chute 30 and toward the feeding device 16. These fixed-position rollers 42, like the upstream adjustable-position rollers 34, are not powered and preferably freely rotate. The narrow gap between the fixed-position rollers 42 can help to crease folds in the sheet stock material that were formed during the gathering and converging process in the converging chute 30. A tunnel member 44 leads from these rollers 42 at the downstream end of the converging chute 30 to the feeding device 16. The tunnel member 44 constrains the sheet stock material in its crumpled state and guides the crumpled stock material to the feeding device 16.

Figure 4:
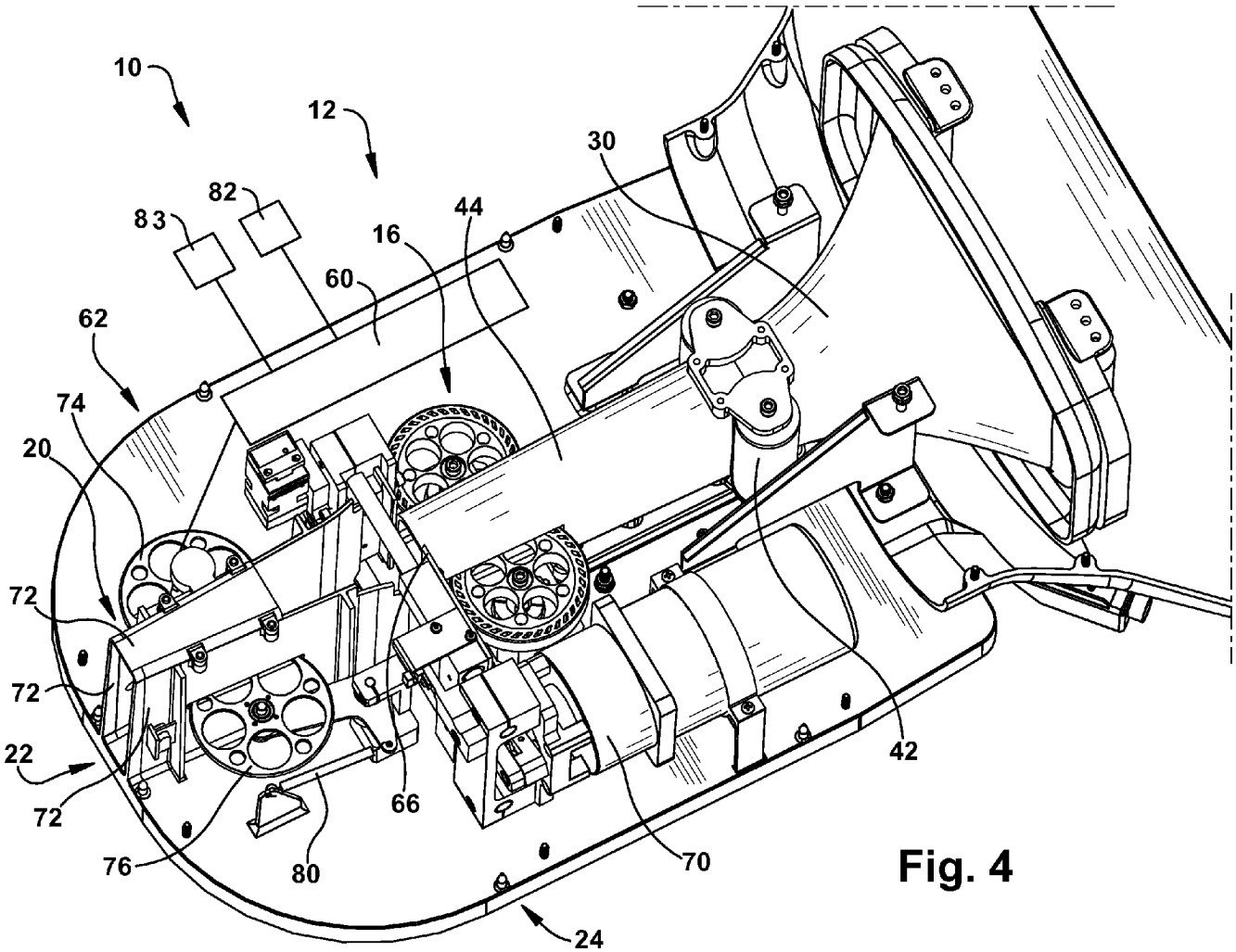
FIG. 4 is an enlarged perspective view of a downstream end of the conversion machine of FIG. 1, with the transparent housing removed to more clearly show the internal components.
Figure 5:
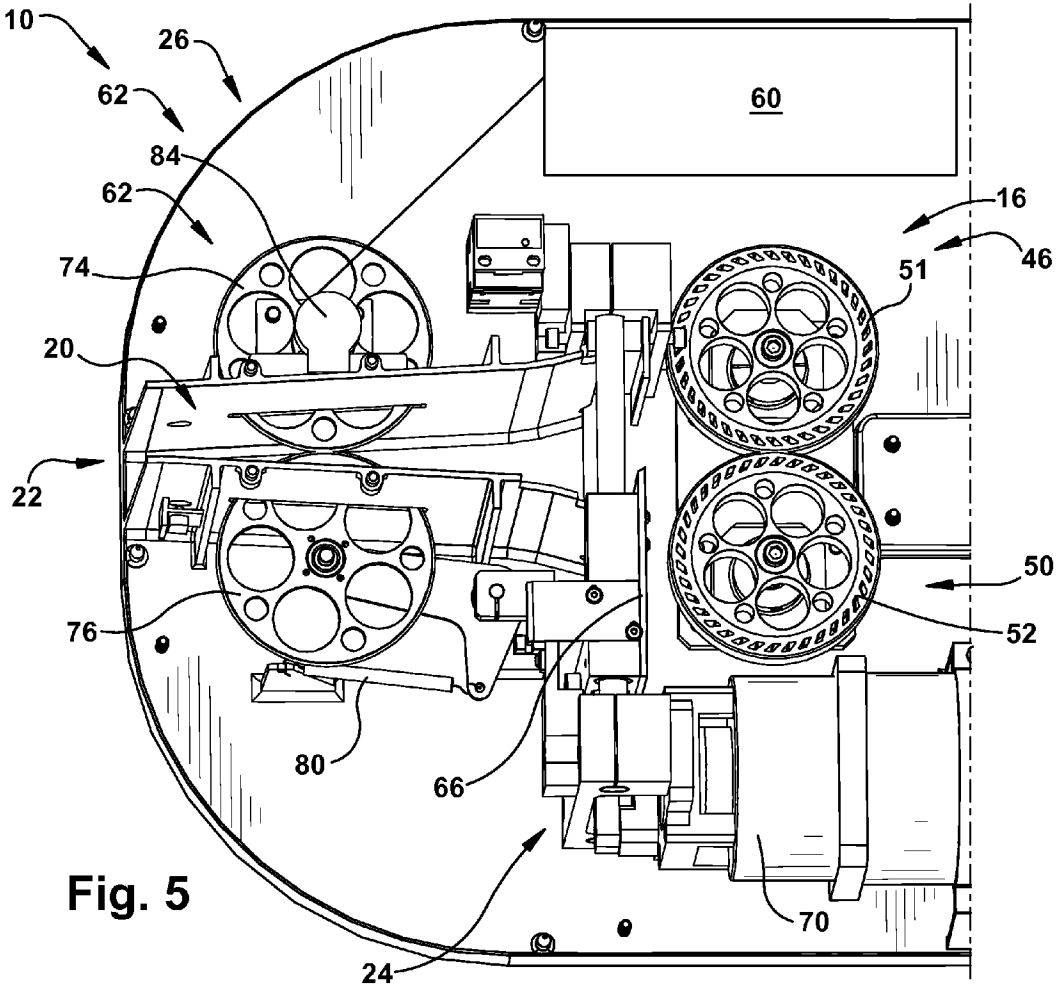
FIG. 5 is an enlarged perspective view of a downstream end of the conversion machine of FIG. 4 with additional internal wall structures removed to more clearly show the internal components of the machine.

Turning now to FIGS. 4 and 5, the feeding device 16 feeds the sheet stock material through the conversion assembly 12 and out the conversion machine 10. In the illustrated embodiment the feeding device 16 includes at least one rotatable feed member that extends into the path of the sheet stock material. More particularly, the feeding device 16 includes first and second rotatable feed members 46 and 50 on respective opposite sides of the path of the sheet stock material to feed the sheet material therebetween. The tunnel member 44 that is part of the forming device 16 also helps to define the path for the sheet stock material up to and through the feeding device 16.

The feed members 46 and 50 in the illustrated embodiment include a pair of resilient wheels 51 and 52, one of which is driven by a motor 54 and a gearbox 56, the motor 54 being controlled by a controller 60 (shown schematically). The controller 60 controls the feeding device 16 based on the output from the sensor 62 in the sensing device 26, which is described further below. This is accomplished by controlling the feed motor 54, for example.

The illustrated wheels 51 and 52 are made of a resilient material and include holes that further facilitate movement of the wheel material to allow the sheet material to pass between the closely-spaced feed wheels 51 and 52. An elastomeric or rubber-like material can be used to make the feed wheels 51 and 52 such that they will have both the necessary resiliency and sufficient friction to engage and pull the sheet stock material from the supply, through the forming device 14, through the feeding device 16, past the severing device 24 and out the output chute 20. Alternatively, the feed members can be paddle wheels or gears, either of which would advance the sheet stock material. Depending on their spacing, these types of feed member also could crimp, cut, or otherwise act on the sheet stock material passing through the feeding device. If non-resilient feed members are employed, at least one feed member is preferably resiliently biased into the path of the sheet material.

The severing device 24 includes a guillotine-style cutting blade 66 that is driven by a cut motor 70 to travel across the path of the sheet stock material. The controller 60 also controls operation of the cut motor 70 and thus the severing operation. In an exemplary embodiment, the controller 60 includes a logic instruction that prohibits the severing device 24 from operating while the feeding device 16 is operating or during a detected jam condition. Alternatively, a single motor may be employed and a clutch can be employed to selectively drive either the feeding device 16 or the severing device 24.

The walls 72 of the output chute 20 define a passage downstream of the severing device 24. These walls 72 define a path from the severing device 24 out of the conversion machine 10 and further assist in constraining the sheet stock material and help to maintain column strength in the sheet stock material so that additional sheet stock material moving downstream can push the severed length of dunnage out of the output chute 20 through the outlet 22.

Also downstream of the feeding device 16 and the severing device 24 is a sensor 62 for the sensing device 26 for detecting movement of the sheet stock material at a point downstream of the feeding device 16. The sensor 62 provides an output corresponding to the sensed or detected movement. In the illustrated embodiment, the sensing device 26 includes a pair of wheels 74 and 76, one of which 76 is biased by a spring 80 toward the other wheel 74, which is mounted for rotation in a fixed position but which extends through a wall 72 of the output chute 20 and into the path of the stock material to engage the stock material and detect whether or not the stock material is moving. The sensing device 26 does this through an encoder 84 mounted to the axle of the rotating wheel 74 to monitor rotation of the axle to which the wheel 74 is attached. The axes of the sensing wheels 74 and 76 are parallel to the axes of the feeding wheels 51 and 52. This is believed to provide better tracking of the sensing wheels against the sheet stock material. The respective pairs of axes are not limited to this arrangement and the respective axes may be offset or even perpendicular. The encoder 84 converts motion of the shaft into an electronic signal that it communicates with the controller 60, either through a wire or wirelessly. Thus the sensor 62 is the encoder 84.

In an exemplary embodiment, the controller 60 monitors the signal output from the sensor 62. When the feeding device 16 is activated to feed sheet stock material, and after a suitable delay to ensure that the stock material has time to travel from the feeding device 16 to the sensor 62, the controller 60 monitors the signal output from the sensor 62. If the signal indicates no motion or movement at a rate below a predetermined value, a percentage, or an amount of decrease in movement, the controller 60 will slow or stop the feed motor 54 for a predetermined time. The feeding device is restarted after a predetermined time or after a signal input by an operator. In our experience, many times an operator can pull on a section of the stock material that extends from the machine 10 and then continue the operation of the feeding device 16 without having to open the housing to clear a jam. Thus the controller 60 is effectively preventing a jam condition and detecting a potential for a jam before a significant jam condition occurs that would require more time-consuming intervention.

In detecting movement of the sheet stock material the sensor 62 may also detect the speed of the stock material. The controller 60 can then control the feeding device 16 by slowing the feeding device 16 when the sensor 62 detects a jam condition. The condition can exist where the downstream speed falls from a first speed above a predetermined value to a second speed at or below the predetermined value. The jam condition exists when the feeding device 16 is energized and no movement is detected by the sensor 62 during a predetermined period, for example. The sensing device 62 can also include an output device 82 (shown schematically) connected to the controller 60 to output an alert to alert an operator that a jam condition exists. The output device can include a light or a speaker or other means for alerting the operator.

In an alternative embodiment (not shown), the sensing device 26 can include a second sensor that detects operation of the feeding device 16, such as an encoder mounted to one of the feed wheels 51 or 52. This would allow the controller 60 to compare the speed at the feed wheels 51 and 52 to the speed at the sensor wheels 74 and 76. The speed could be determined assuming that the sheet stock material would be moving at the same speed as a peripheral portion of the respective wheel where it engages the sheet stock material.

The controller 60 can also include an input device 83 (shown schematically) connected to the controller 60 for an operator to indicate that a jam condition has been resolved. The input device can include a switch, a footswitch, a button switch, a keypad or any other switch that would allow the conversion machine to resume operation after resolution of the jam condition.

In operation, when the controller 60 detects a potential jam condition, based on the signal received from the sensor 62, the controller 62 slows down or stops the feed motor 54 and thus the feeding device 16. After a predetermined time, the controller 60 can return the feed motor 54 and feeding device 16 to full speed operation and the potential jam condition often will resolve without any operator intervention. In some circumstances, the operator pulls on a portion of the sheet material extending from the outlet 22 before the controller 60 resumes full speed of the motor 54 and the feeding device 16, either automatically after a predetermined time or upon receiving a signal from the operator via the input device 83. Again, the operator's intervention is simple and does not require the time-consuming procedure of opening the housing 28 of the conversion machine 10 to clear the jam. The operator may observe the slowing or stopping of the feeding device 16, or the controller 60 can provide a signal to the output device 82 to alert the operator to the potential for a jam condition so that the operator can assist the controller 60 in resolving the jam condition before a more time-consuming procedure is required.

The controller 60 can store in memory the number of potential jam conditions and their time or frequency to facilitate maintenance and repair at a scheduled down time for maintenance. The controller 60 also could alert an operator to frequent potential jam conditions as a way of signaling a need for maintenance or inspection. In this way the controller both prevents potential jam conditions from becoming more time-consuming for the operator during operation and provides a record for improving maintenance procedures to further minimize or eliminate time-consuming jam conditions.

Early detection and prevention of jam conditions also facilitates the use of different grades of sheet stock material. As a result, the same conversion machine or type of conversion machine can operate with both high and low quality sheet stock material, and/or different thicknesses or basis weights of stock material. This flexibility makes operation of the machine more economical since a user's needs may change over time.

Putting it another way, the present invention provides a conversion machine 10 with a conversion assembly 12 that includes means for feeding a sheet stock material through the conversion assembly, means for sensing movement of the sheet stock material downstream of the conversion assembly 12, and means for controlling the feeding means in response to a signal from the sensing means. In this characterization, the feeding means includes a rotatable feed member 46 or 50 that extends into a path of sheet material, the sensing means includes a rotatable member 74 or 76 that extends into a path of sheet material downstream of the feed member 46 or 50, and an encoder 84 coupled to the rotatable member 74. The modulating means includes a controller 60 coupled to the rotatable feed member via the encoder 84.

The controller 60 can control operation of the rotatable feed members 51 and 52 in response to signals from the encoder 84.

In summary, the present invention provides a dunnage conversion machine 10 that provides an improved electronic monitoring and control system for detecting and resolving many jamming conditions before they require significant operator intervention. The machine includes 10 a conversion assembly 12 with a feeding device 16 that feeds the sheet stock material through the machine 10, and a sensing device 26 downstream of the feeding device 16 to monitor movement of the stock material downstream of the feeding device 16 and to output a corresponding signal. A controller 60 controls operation of the feeding device 16 in response to the signal from the sensing device 26. The controller 60 uses the signal to detect a potential jam condition and controls the feeding device 16 to prevent or minimize the occurrence or severity of the jam condition, thereby minimizing the amount and degree of required operator intervention.

The present invention provides one or more of the features described in the following clauses:

A. A machine 10 for converting a sheet stock material into a relatively lower density dunnage product, comprising: a conversion assembly 12 for converting a sheet stock material into a relatively lower density dunnage product, the conversion assembly 12 including a feeding device 16 to feed the sheet stock material through the conversion assembly 12; a sensor 62 downstream of the feeding device 16 to detect movement of the sheet stock material at a point downstream of the feeding device 16 and providing an output corresponding to the movement; and a controller 60 that controls the feeding device 16 based on the output from the sensor 62.

B. A machine 10 as set forth in clause A or any other clause that depends from clause A, where the sensor 62 detects the speed of the stock material and the controller 60 controls the feeding device 16 by slowing the feeding device 16 when the sensor 62 detects a jam condition where the downstream speed falls from a first speed above a predetermined value to a second speed at or below the predetermined value.

C. A machine 10 as set forth in clause A or any other clause that depends from clause A, where the controller 60 controls the feeding device 16 by slowing the feeding device 16 when the sensor 62 detects a jam condition where the feeding device 16 is energized and no movement is detected by the sensor 62 during a predetermined period.

D. A machine 10 as set forth in clause A or any other clause that depends from clause A, where the feeding device 16 includes at least one rotatable feed member 46 that extends into a path of the sheet material.

E. A machine 10 as set forth in clause D or any other clause that depends from clause D, where the feeding device 16 includes a pair of feed members 46 and 50 on opposing sides of the path of the sheet material to feed the sheet material therebetween.

F. A machine 10 as set forth in clause D or any other clause that depends from clause D, where the sensor 62 includes at least one wheel 76 that is biased into the path of the sheet material and is movable out of the path of the sheet material.

G. A machine 10 as set forth in clause D or any other clause that depends from clause D, where the at least one feed member 46 or 50 includes at least one of a friction wheel, a paddle wheel, and a gear.

H. A machine 10 as set forth in clause D or any other clause that depends from clause D, where the sensor 62 includes a rotatable member 74 or 76 extending into a path of the sheet material and an encoder 84 connected to the controller 60 that converts rotation of the rotatable member 74 or 76 into an electrical signal output to the controller 60.

I. A machine 10 as set forth in clause A or any other clause that depends from clause A, where the conversion assembly 12 includes a converging chute 30 upstream of the feeding device 16 that converges in at least one dimension in an upstream-to-downstream direction.

J. A machine 10 as set forth in clause A or any other clause that depends from clause 1, further comprising a severing device 26 downstream of the feeding device 16 to sever discrete lengths of dunnage from the sheet material, the controller 60 controlling the severing device 26 in coordination with the feeding device 16.

K. A machine 10 as set forth in clause A or any other clause that depends from clause A, further comprising an output device coupled to the controller 60 to alert an operator that a jam condition exists.

L. A machine 10 as set forth in clause A or any other clause that depends from clause A, comprising a sensor 62 that detects operation of the feeding device 16.

M. A machine 10 as set forth in clause A or any other clause that depends from clause A, further comprising an input device coupled to the controller 60 for an operator to indicate that a jam condition has been resolved.

N. A method of controlling a machine that converts a sheet stock material into a relatively lower density dunnage product, comprising the following steps: feeding a sheet stock material through a conversion assembly; sensing movement of the sheet stock material downstream of the conversion assembly; modulating the feeding step in response to the sensing step.

O. A method as set forth in clause N or any other clause that depends from clause 14, where the modulating step includes slowing the feed speed when the downstream speed falls from a first speed above a predetermined value to a second speed at or below the predetermined value.

P. A method as set forth in clause O or any other clause that depends from clause O, where the modulating step includes slowing the feed speed by at least one of a predetermined absolute amount, and a predetermined percentage, or slowing the feed speed to a predetermined reduced speed that is less than the feed speed.

Q. A method as set forth in clause N or any other clause that depends from clause N, comprising the steps of detecting operation of a feeding device that performs the feeding step, where the modulating step includes reducing the feeding step when the feeding device is operating and no movement is sensed during a predetermined period.

R. A method as set forth in clause P or any other clause that depends from clause P, where the modulating step includes stopping the feeding step.

S. A method as set forth in clause P or any other clause that depends from clause P, where the modulating step includes increasing the feed speed a predetermined time after the slowing step.

T. A method as set forth in clause S or any other clause that depends from clause S, where the modulating step includes increasing the feed speed after the slowing step in response to an operator input.

U. A method as set forth in clause N or any other clause that depends from clause N, where if the sensing step includes detecting no movement for a predetermined time, then the modulating step includes stopping the feeding step.

V. A machine 10 for converting a sheet stock material into a relatively lower density dunnage product, comprising: a conversion assembly 12 including means 16, 46 and 50, 51 and 52, 54, 56 for feeding a sheet stock material through the conversion assembly 12; means 26, 62, 74 and 76, 84 for sensing movement of the sheet stock material downstream of the conversion assembly 12; and means 60 for controlling the feeding means in response to a signal from the sensing means.

W. A machine 10 as set forth in clause V or any other clause that depends from clause V, where the feeding means includes a rotatable feed member 46 or 50 that extends into a path of the sheet material, the sensing means includes a rotatable member 74 or 76 that extends into a path of the sheet material downstream of the feed member and an encoder 84 coupled to the rotatable member 74 and 76, and the modulating means includes a controller 60 coupled to the rotatable feed member 74 and 76 and the encoder 84.

Although the invention has been shown and described with respect to a certain illustrated embodiment or embodiments, equivalent alterations and modifications will occur to others skilled in the art upon reading and understanding the specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function (i.e., that is functionally equivalent), even though not structurally equivalent to the disclosed structure which performs the function in the herein illustrated embodiment or embodiments of the invention.

I claim:

1. A machine for converting a sheet stock material into a relatively lower density dunnage product, comprising: a conversion assembly for converting a sheet stock material into a relatively lower density dunnage product, the conversion assembly including a feeding device to feed the sheet stock material through the conversion assembly, wherein the feeding device includes at least one rotatable feed member that extends into a path of the sheet material; a sensor downstream of the feeding device to detect the speed of the sheet stock material at a point downstream of the feeding device, the sensor being configured to provide an output corresponding to the detected speed; and a controller that controls the feeding device based on the output from the sensor, where the controller is configured to control the feeding device by slowing the feeding device when the sensor detects a jam condition where the detected speed falls from a first speed above a predetermined value to a second speed at or below the predetermined value; wherein the sensor includes a rotatable member extending into a path of the sheet material and an encoder connected to the controller that converts rotation of the rotatable member into an electrical signal output to the controller.

2. A machine as set forth in claim 1, where the controller is configured to control the feeding device by slowing the feeding device when the sensor detects the jam condition where the feeding device is energized and no movement is detected by the sensor during a predetermined period.

3. A machine as set forth in claim 1, where the feeding device includes a pair of feed members on opposing sides of the path of the sheet material to feed the sheet material therebetween.

4. A machine as set forth in claim 1, where the sensor includes at least one wheel that is biased into the path of the sheet material and is movable out of the path of the sheet material.

5. A machine as set forth in claim 1, where the at least one feed member includes at least one of a friction wheel, a paddle wheel, and a gear.

6. A machine as set forth in claim 1, where the conversion assembly includes a converging chute upstream of the feeding device that converges in at least one dimension in an upstream-to-downstream direction.

7. A machine as set forth in claim 1, further comprising a severing device downstream of the feeding device to sever discrete lengths of dunnage from the sheet material, the controller controlling the severing device in coordination with the feeding device.

8. A machine as set forth in claim 1, further comprising an output device coupled to the controller, where the controller is configured to signal the output device when the jam condition exists.

9. A machine as set forth in claim 1, where the sensor downstream of the feeding device to detect the speed of the sheet stock material is a first sensor, and further comprising a second sensor that detects operation of the feeding device.

10. A machine as set forth in claim 1, further comprising an input device coupled to the controller for an operator to indicate that the jam condition has been resolved.

11. A machine as set forth in claim 1, where the controller is configured to control the feeding device by stopping the feeding device when the feeding device is energized and no movement is detected by the sensor after a predetermined period.

* * * * *